United States Patent [19]

Collier

[11] 3,938,839

[45] Feb. 17, 1976

[54] SLIDING WINDOW LOCK

[75] Inventor: William S. Collier, Northglenn, Colo.

[73] Assignee: The Raymond Lee Organization, Inc., New York, N.Y. ; a part interest

[22] Filed: Nov. 19, 1974

[21] Appl. No.: 525,158

[52] U.S. Cl. ..... 292/258; 292/288; 292/DIG. 46; 292/DIG. 47

[51] Int. Cl.[2] ..... E05C 19/18

[58] Field of Search .... 292/258, 288, 294, DIG. 20, 292/DIG. 46, DIG. 47

[56] References Cited

UNITED STATES PATENTS

| | | | |
|---|---|---|---|
| 84,767 | 12/1868 | Ross | 292/288 |
| 746,824 | 12/1903 | Gray | 292/296 |
| 915,593 | 3/1909 | Greeno | 292/DIG. 20 |
| 1,055,941 | 3/1913 | Morrison | 292/294 |
| 1,196,446 | 8/1916 | Ellis | 292/288 |
| 1,429,256 | 9/1922 | Ritchie | 292/DIG. 20 |
| 2,537,380 | 1/1951 | Travis | 292/288 |
| 2,775,001 | 12/1956 | Baker | 292/288 |
| 3,216,605 | 11/1965 | Hughes | 292/288 |
| 3,347,585 | 10/1967 | Chmura | 292/288 X |

*Primary Examiner*—Paul R. Gilliam
*Assistant Examiner*—Carl F. Pietruszka
*Attorney, Agent, or Firm*—Daniel Jay Tick

[57] ABSTRACT

A plate-like clip member is bent at one end and is positioned inside a window between parallel first and second units slidable relative to each other and fits over the edge of one of the units at its bent end. An elongated clamp member is bent at one end. The clamp member is positioned inside the window in operative proximity with the clip member and fits over the edge of the other of the units at its bent end. A fastening device releasably affixes the clamp member to the clip member inside the window thereby preventing relative movement of the members and the window units.

1 Claim, 2 Drawing Figures

SLIDING WINDOW LOCK

DESCRIPTION OF THE INVENTION

The present invention relates to a sliding window lock. More particularly, the invention relates to a sliding window lock for a sliding window having a pair of parallel units each of which is slidable relative to the other.

Objects of the invention are to provide a sliding window lock of simple structure, which is inexpensive in manufacture and functions efficiently, effectively and reliably to keep a pair of parallel sliding window units locked in position either closed or in selected positions relative to each other.

Figure 1:
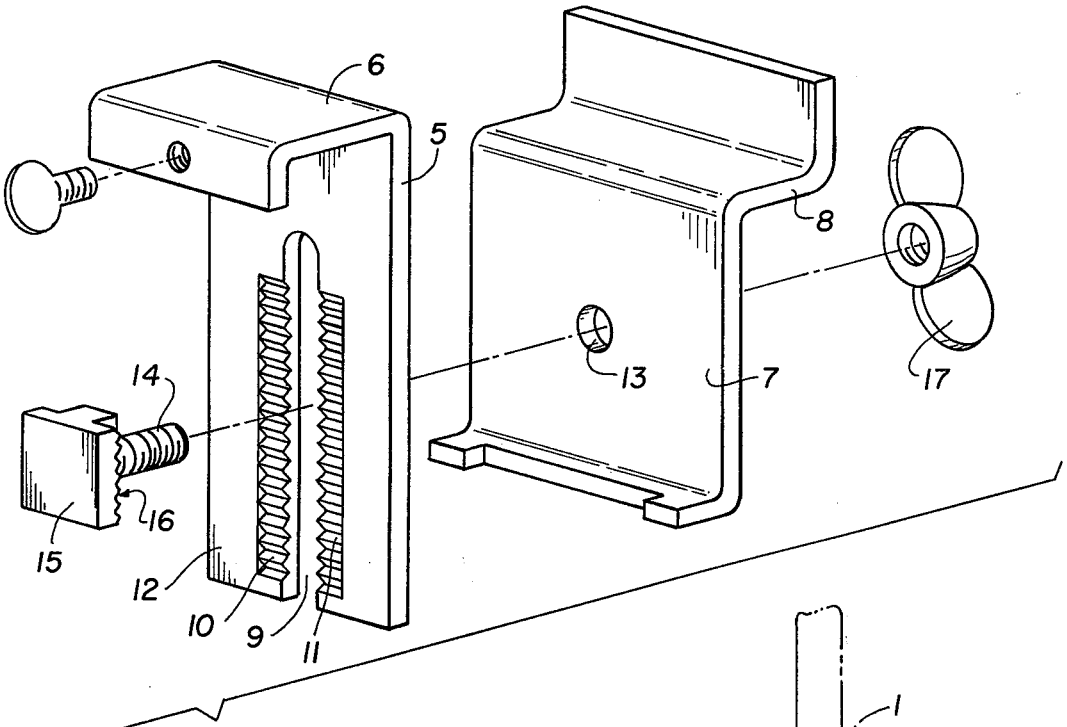
Figure 2:
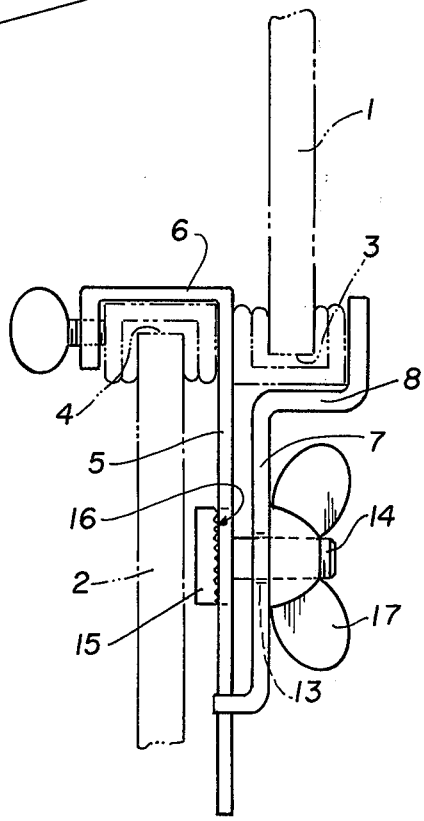

In order that the invention may be readily carried into effect, it will now be described with reference to the accompanying drawing, wherein:

FIG. 1 is an exploded schematic diagram of an embodiment of the sliding window lock of the invention; and FIG. 2 is a side view of the embodiment of FIG. 1 locking a window in closed position.

In the FIGS., the same components are identified by the same reference numerals.

The sliding window lock of the invention is for a sliding window, as shown in FIG. 2, having a pair of substantially parallel units 1 and 2, each of which is slidable relative to the other. The window units are positionable with a first of the units 1 having a bottom edge portion 3 and a second of the units 2 having a top edge portion 4 overlapping the bottom edge portion of the first unit.

A substantially plate-like clip member 5 is bent at one end 6 and is positioned inside the window between the first and second units 1 and 2. The clip member 5 fits over the upper edge 4 of the unit 2 at its bent end 6.

A substantially elongated clamp member 7 is bent at one end 8 and is positioned inside the window in operative proximity with the clip member 5 and fits over the lower edge 3 of the window unit 1 at its bent end 8.

A fastening device releasably affixes the clamp member 7 to the clip member 5 inside the window thereby preventing relative movement of the members and the window units 1 and 2. The fastening device comprises a slot 9 formed through the clip member 5. Serrations 10 and 11 are formed in the surface 12 of the clip member 5 along the edges of the slot 9. A bore 13 is formed through the clamp member 7. A bolt 14 passes through the slot 9 and the bore 13. The bolt 14 has a head 15 with a serrated undersurface 16 in abutment with the serrations 10 and 11 in the surface of the clip. A wing nut 17 is threadedly coupled to the bolt and releasably secures said bolt.

While the invention has been described by means of a specific example and in a specific embodiment, I do not wish to be limited thereto, for obvious modifications will occur to those skilled in the art without departing from the spirit and scope of the invention.

I claim:

1. A sliding window lock for a sliding window having a pair of substantially parallel units each of which is slidable, relative to the other and which are positionable with a first of the units having a bottom edge portion and the second of the units having a top edge portion overlapping the bottom edge portion of the first unit, said lock comprising a substantially plate-like clip member bent at one end at substantially right angles to the remainder thereof to form a head part, the clip member being positioned inside the window between the first and second units with the head part thereof fitting over the edge of one of the units, said clip member having a slot formed therethrough in the remainder thereof and extending longitudinally therealong and serrations formed in the surface of said clip member along the slot and extending from both longitudinal edges of the slot substantially perpendicularly thereto;

a substantially elongated clamp member bent at one end at substantially right angles to the remainder thereof to form a first head part, bent at the first head part at substantially right angles to the remainder of the head part to form a lip, and bent at an opposite end at substantially right angles to the remainder thereof to form a second head part extending in a plane substantially parallel to the first head part, the first and second head parts extending in opposite directions from the remainder of the clamp member, said second head part having a free edge and a cutout formed therein for accommodating the clip member, the clamp member being positioned inside the window in operative proximity with the clip member with the first head part thereof fitting over the edge of the other of the units bordered by the lip thereof, said clamp member having a bore formed through the remainder thereof; and fastening means for releasably affixing the clamp member to the clip member inside the window thereby preventing relative movement of said members and said window units, said fastening means comprising a bolt passing through the slot and the bore and having a head with a serrated undersurface in abutment with the serrations in the surface of the clip, and a wing nut threadedly coupled to the bolt and releasably securing said bolt.

* * * * *